US012590429B2

(12) United States Patent
Buzzard, Jr.

(10) Patent No.: US 12,590,429 B2
(45) Date of Patent: Mar. 31, 2026

(54) TELESCOPIC POOPER SCOOPER

(71) Applicant: Ronald William Buzzard, Jr., Auburn, WA (US)

(72) Inventor: Ronald William Buzzard, Jr., Auburn, WA (US)

( * ) Notice: Subject to any disclaimer, the term of this patent is extended or adjusted under 35 U.S.C. 154(b) by 971 days.

(21) Appl. No.: 17/803,216

(22) Filed: Mar. 21, 2022

(65) Prior Publication Data

US 2023/0295887 A1 Sep. 21, 2023

(51) Int. Cl.
*E01H 1/12* (2006.01)

(52) U.S. Cl.
CPC ... *E01H 1/1206* (2013.01); *E01H 2001/1293* (2013.01)

(58) Field of Classification Search
CPC ..... A01K 23/005; B65F 1/00; B65F 1/0013
See application file for complete search history.

(56) References Cited

U.S. PATENT DOCUMENTS

| | | | | |
|---|---|---|---|---|
| 5,400,989 | A * | 3/1995 | Gaskill | B65F 1/06 248/152 |
| 6,942,264 | B1 * | 9/2005 | Mendez | A01K 23/005 294/1.5 |
| 7,404,499 | B1 * | 7/2008 | Ramsey | B65F 1/06 220/495.11 |
| 8,511,728 | B2 * | 8/2013 | Beaton | A01K 23/005 294/1.4 |
| 10,465,351 | B1 * | 11/2019 | Perez | E01H 1/1206 |
| 11,141,336 | B2 * | 10/2021 | Marshall | A61G 9/003 |
| 2024/0196862 | A1 * | 6/2024 | Masters | A01K 23/005 |

FOREIGN PATENT DOCUMENTS

| | | | | |
|---|---|---|---|---|
| CA | 2253188 | A1 * | 4/2000 | A01K 23/005 |
| DE | 102005034630 | A1 * | 2/2007 | A01K 23/005 |
| DE | 102007013170 | A1 * | 9/2008 | A01K 23/005 |
| FR | 2712142 | A1 * | 5/1995 | A01K 23/005 |
| GB | 2416110 | A * | 1/2006 | A01K 23/005 |
| KR | 20240103624 | A * | 7/2024 | A01K 23/005 |

* cited by examiner

*Primary Examiner* — Minh Truong

(57) ABSTRACT

The Telescopic Pooper Scooper has a thin metal telescopic handle that extends from 6 inches long to up to 3 feet for the animal's owner to be able to insert the poop catching bag down the middle of the plastic ring and fold the sides of the bag over the top of the ring and clip the poop bag into the three outside clips to hold it. And then extend it out from their hand to reach under the animals behind to catch the poop directly into the bag so they do not have to touch the poop through the bag making the entire experience of taking the animal outside to poop, especially for dog walkers and owners who live in apartments, more hygienic, convenient, and saves time for the owner or animal walker. It's less messy, and less damage to grass. Which makes it easier if it's raining when walking them you do not have to stop and try to pick up the poop with one hand through a thin plastic bag while trying to handle the animal on a leash and trying to pick up the poop. I invented this mainly for dogs but it can be used for pet potbelly pigs and other animals as well.

2 Claims, 2 Drawing Sheets

1/2" Thick Ring
3"
1 1/2"
3/4 TOP VIEW
1"x 1 1/2" Oval Shaped Push In Bag Holding Clips
6"-36" Telescopic Handle Extends From 6" To 36" Length 2" Key Ring Attach To Leash
1/2" Ring 1"
1.5"
SIDE VIEW
6" Telescopic Handle Pulls Out To 36"
1"x 1.5" Oval Shaped Push In Bag Holding Clips 1.5"
FRONT VIEW
2" Key Ring 3"
1/2" Double Walled Ring
BOTTOM VIEW
4"

TELESCOPIC POOPER SCOOPER

(1) BACKGROUND OF THE INVENTION

The Telescopic Pooper Scooper is in the animal and pet field of endeavor. This telescopic ring invention solves the problem of not having to pick up the animal's poop with your hand with only a thin plastic bag. By clipping the bag on the outside oval shaped clips of the ring and not having to touch the poop with your hand since the poop goes into the bag and then the bag is pulled out and thrown away. And with the growing industry of animal walkers, especially dog walkers, and the growing majority of pets that are owned by people living in apartments which have to be taken into public to be allowed to poop. This will speed up, make less embarrassing and more hygienic process of retrieving the animals animal's poop.

2) BRIEF SUMMARY OF THE INVENTION

The Telescopic Pooper Scooper gives the user the advantage of not having to pick up their animal's excrement by hand with nothing but a thin bag on their hand which is not hygienic. Once the animal finishes pooping into the bag that is clipped into the Telescopic Pooper Scooper the owner just has to pull the bag out and tie it, drop it into the trash, or if they have the self sealing bags then they just pull the bag out of the ring and it seals itself without having to touch the poop.

(3) BRIEF DESCRIPTION OF THE DRAWINGS

Figures 1A, 1B:
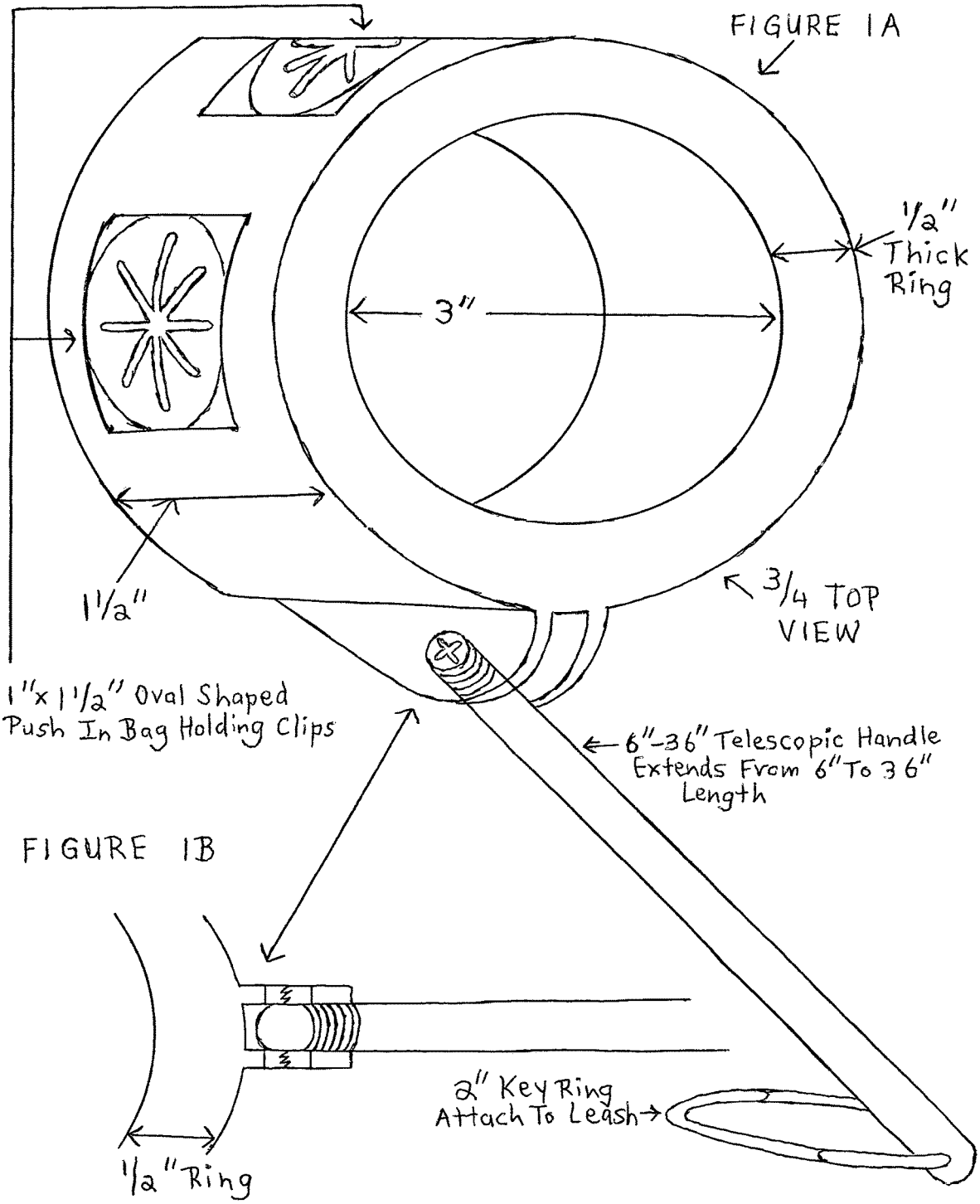

Sheet one—This is the front page View. FIG. 1A—An angled perspective view that shows both the ½ inch sides, angled perspective view of the 3 inch interior rings opening, six inch telescopic handle, handle mounting tabs, and the 1 inch by 1.5 inch oval shaped side and front push in tabs that hold in the poop bag, including the 1.5 inch side of the ring is also shown, as well as the 2 inch key ring attached to the end of the handle.

FIG. 1B—This is a top view of the mounting tab that hold the telescopic handle.

Figures 2A, 2B, 2C:
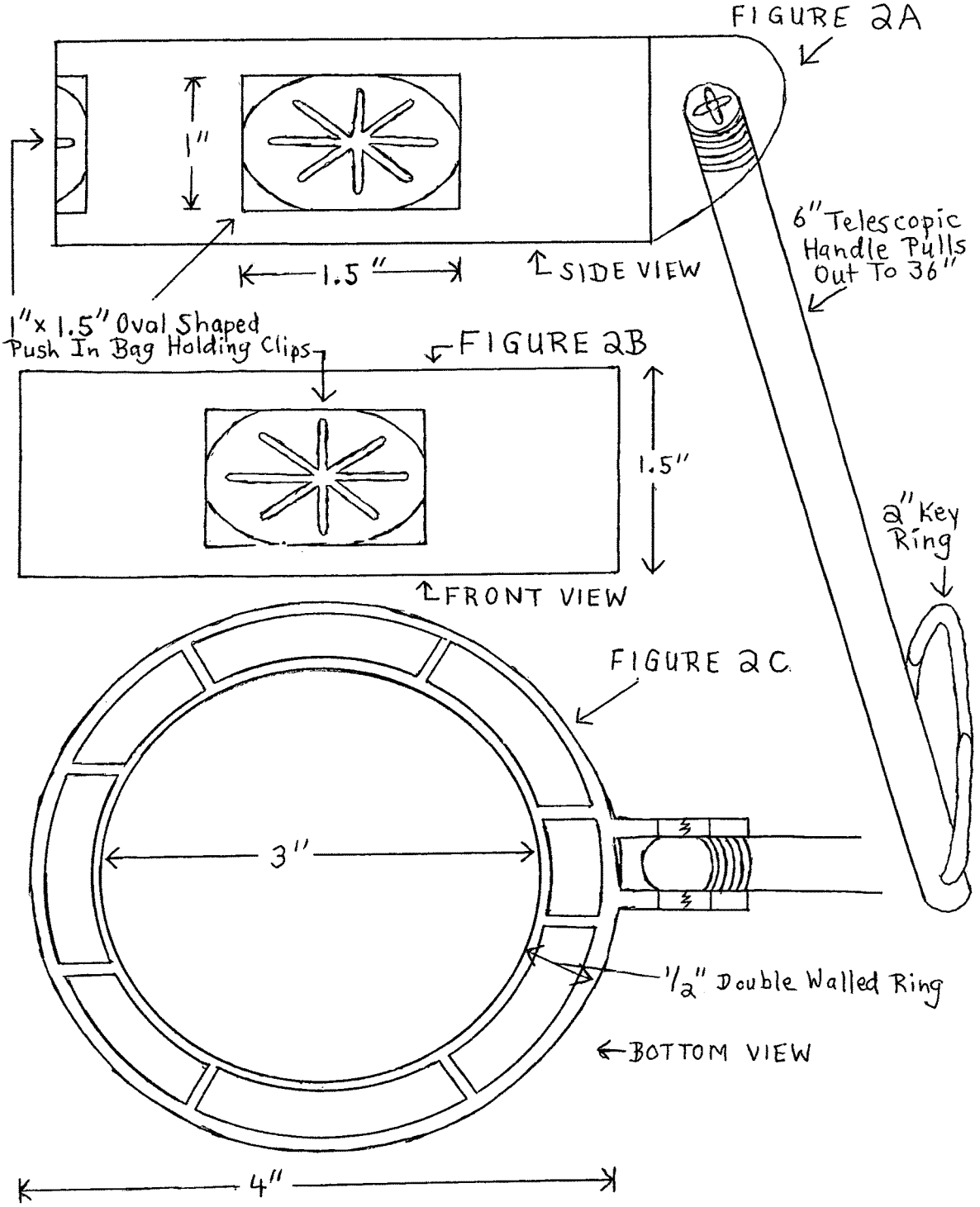

Sheet 2—FIG. 2A—This is a side view of the ring with tab and handle and 2 inch key ring.

FIG. 2B—This is a front view of the ring which shows the 1 inch by 1.5 inch oval shaped push in bag holding tabs.

FIG. 2C.—This is a bottom view of the ring showing the interior cross bars that support the oval shaped push in bag holding tabs and partial handle.

(4) DETAILED DESCRIPTION OF THE INVENTION

The Telescopic Pooper Scooper is a two concentric injection molded plastic rings. On three sides of the outer concentric ring there is a thin plastic push in oval clips with a cut in an asterisk pattern to hold the bag that holds the poop as it is caught while animal is pooping. On the fourth side there is an attached telescopic handle that allows the user to extend the ring out from the handle to the length needed to hold it under the animals posterior while it is defecating. The handle is attached to the ring by vertical double tabs that are 1/16 inch thick with two holes that hold a thread locking screw insert.

There is a 2 inch key ring on the end of the Telescopic handle so the owner can attach it to their leash handle. And the Telescopic handle is attached to the middle of two vertical tabs with a tightening crew that is held in place by a thread locking nut ring in both vertical tabs that helps the owner adjust the angle of the catching ring which the bag is attached.

The plastic ring if looking at the cross-section out would look like an upside down shaped "u". The ring will be formed by making a mold and injecting liquid plastic into the mold with a reinforcement bar to reinforce the ring from collapse on the inside on both sides of the push in oval shaped side clips. The ring is ½ inch from side to side, ⅛ inch thick plastic, initial inside diameter of the ring is 3 inch with the side height of the ring is 1.5 inch, and the oval shaped side clips will be 1/16 inch thick, but will be manufactured in other diameters depending on the animals excrement size. This invention is distinguished from old pooper scoopers by two ways, which include the Telescopic handle, and the clips that allow the owner to not have to use their hand to pick up the poop through the bag since the bag clips into three outside push in clips. The telescopic handle extends to three feet from 6 inch telescopic rods that collapse into each other after use. And the reason the three oval shaped clips are on the outside is so the holding bag can be inserted down the middle and folded over the sides of the ring to keep the ring clean and so the bag can be pushed into the clips to hold the bag.

The invention claimed is:

1. A telescopic pooper scooper, comprising:

a six-inch long telescopic handle configured to be manually pulled out to extend up to 36 inches in length;

a 2-inch key ring threaded through a hole at a first end of the handle for attaching an animal leash thereto;

a bag holder comprising an outer ring and an inner ring concentric to the outer ring, a circumferential surface of the outer ring comprising a plurality of push in clips configured to a plastic bag, a backside of the outer ring includes two molded flat vertical plastic clips, and reinforcement bars configured to connect the inner ring and the outer ring;

wherein a second end of the telescopic handle is mounted to the two plastic clips by a screw that fits through each threaded locking screw inserts of the two plastic clips, each threaded locking screw insert is positioned on each side of the telescopic handle; and wherein the reinforcement bars are arranged radially between the concentric rings and circumferentially between a push in clip and a flat vertical plastic clip.

2. The telescopic pooper scooper of claim 1, wherein; the plurality of push in clips includes three thin, flexible, oval-shaped push in plastic clips with asterisk-shaped pattern cut out at its center, the push in clips are snapped into the circumferential surface of the outer ring at three positions equally spaced apart on the outer ring, wherein the three push in clips are configured to hold the plastic bag in between the concentric rings to catch poop while an animal is pooping.

* * * * *